US007976395B2

(12) United States Patent
Healey

(10) Patent No.: US 7,976,395 B2
(45) Date of Patent: Jul. 12, 2011

(54) PORTABLE PUPPET THEATER, STAGE, OR PLAYHOUSE APPARATUS AND METHODS

(75) Inventor: Janet Healey, Provo, UT (US)

(73) Assignee: Janet Healey, Provo, UT (US)

( * ) Notice: Subject to any disclaimer, the term of this patent is extended or adjusted under 35 U.S.C. 154(b) by 252 days.

(21) Appl. No.: 12/266,484

(22) Filed: Nov. 6, 2008

(65) Prior Publication Data

US 2009/0137183 A1 May 28, 2009

Related U.S. Application Data

(60) Provisional application No. 60/985,930, filed on Nov. 6, 2007.

(51) Int. Cl.
*A63J 1/02* (2006.01)
*A63J 1/00* (2006.01)

(52) U.S. Cl. ..... 472/75; 446/82; 446/478; 160/252

(58) Field of Classification Search ..... 446/82, 446/476, 478, 487; 472/57, 75, 81; 160/252, 160/352

See application file for complete search history.

(56) References Cited

U.S. PATENT DOCUMENTS 836,296 A * 11/1906 Bitner ..... 446/478
1,040,109 A * 10/1912 Amet ..... 472/75
1,408,370 A * 2/1922 Lincoln ..... 312/245
1,808,708 A * 6/1931 Ziemmerman ..... 446/82
2,261,141 A * 11/1941 Davis ..... 160/352
2,334,482 A * 11/1943 Davis ..... 160/268.1
3,363,360 A * 1/1968 Ryan ..... 446/478
4,764,142 A * 8/1988 Griffith et al. ..... 446/82
5,445,565 A * 8/1995 Setteducati ..... 472/57
6,260,707 B1 * 7/2001 Harris ..... 206/575
6,502,596 B1 * 1/2003 Danaher ..... 135/126
7,163,044 B2 * 1/2007 Kirby ..... 160/262

* cited by examiner

*Primary Examiner* — Kien T Nguyen
(74) *Attorney, Agent, or Firm* — Durham Jones & Pinegar Intellectual Property Law Group

(57) ABSTRACT

A portable puppet theater, stage or playhouse comprises hanging wall structure for hanging the puppet theater or playhouse from a door or other vertical surface, enclosure structure for suspending from the hanging wall structure, the enclosure structure being shaped to form an enclosure, and shaping means associated with the enclosure structure for extending the enclosure structure away from a door or other vertical surface. The shaping structure within the enclosure structure may be disposed to be pivotable between a first position extending the enclosure structure away from the door or other vertical surface, and a second position maintaining the enclosure structure substantially flush against the door or other vertical surface.

A method of using a portable puppet theater or playhouse, comprises hanging the puppet theater or playhouse on a surface of a door so that an enclosure member in the puppet theater or playhouse is disposed in a first position extending outward from the surface of the door to provide an enclosure between the surface of the door and the enclosure member, and pivoting the enclosure member towards the surface of the door so that the enclosure member is flush with the surface of the door in a second position.

18 Claims, 11 Drawing Sheets

PORTABLE PUPPET THEATER, STAGE, OR PLAYHOUSE APPARATUS AND METHODS

CROSS REFERENCE TO RELATED APPLICATION

This application claims the benefit of U.S. provisional patent application Ser. No. 60/985,930, filed Nov. 6, 2007, which is incorporated herein in its entirety.

TECHNICAL FIELD

This application relates to a portable puppet theater, stage, or playhouse apparatus and methods. More particularly, this application concerns a portable playhouse, stage, or puppet theater that hangs from a suitable support fixture, such as the top of a door in a house or other building, and to methods for assembling, disassembling, and hanging the portable playhouse, stage, or puppet theater on the support fixture in a first extended position and folding the portable playhouse, stage, or puppet theater into a second collapsed position.

BACKGROUND OF RELATED ART

A variety of different portable puppet theaters, stages and playhouses have been designed and developed for portable usage. Typically, such theater devices are made to be free-standing or to be placed on a table or other device to be carried. Some portable puppet theaters are so small that they can be easily carried. U.S. Pat. No. 6,506,093 (Avital) discloses a miniature puppet theater and book combination, in which a tiny portable puppet theater is contained within a book that can be easily collapsed and carried. In U.S. Pat. No. 5,261,849 (French), a miniature theater is designed for interchangeable platforms so that performance may be given using either hand puppets or marionettes.

Other portable puppet theaters have been designed to break down into sections or pieces to be carried. In U.S. Pat. No. 5,468,171 (Taylor), a small puppet theater is structured in sections that may be collapsed for compact storage in a carry case. In U.S. Pat. No. 5,085,609 (Haberle), a puppet theater is designed to be dissembled into upper and lower halves which may be folded onto each other. In U.S. Pat. No. 4,857,028 (Conrad), a playhouse for small children is provided in which the unit may be disassembled into adjacent walls to be folded on each other. In U.S. Pat. No. 5,194,047 (Cabell), a portable theater assembly is provided for storing, setting up and rapidly changing scenery elements.

In most cases, the portable puppet theaters are made to be free-standing, so they can be assembled anywhere. In U.S. Pat. No. 4,857,028 (Pail), a puppet theater kit is provided which is easily dissembled to fit in a compact portable carrying case. The case has holes for corner rods to extend upwards to support the top of the theater. Curtains may be hung from the top to simulate a theater. In U.S. Published Patent Application 2006-0150530 (Davey), a small theater system is comprised of multiple modules that can be easily assembled or dissembled to change staging and scenery.

The foregoing examples tend to take up space in a room and are not readily assembled and disassembled. Furthermore, they do not usually provide for usage in a home or other play area where space may be at a premium. They often do not have interior space within where one or more people can set up a puppet theater or playhouse for easy usage.

SUMMARY

Embodiments of a portable puppet theater, stage, or playhouse of the present invention are constructed to be hung on a support fixture, such as the top of a door or a rod, in a manner for it to be easily disassembled and stored in a compact form. Alternatively, the portable puppet theater, stage or playhouse may be collapsed without being disassembled and left hanging on one side of a door for later use without taking up any usable space. When assembled, a portable puppet theater, stage or playhouse of the present invention provides for an enclosed compartment that is large enough to accommodate one or more children for play or to carry out a puppet show without being seen.

In one embodiment, a portable puppet theater, stage or playhouse includes a hanging wall structure for hanging the puppet theater or playhouse from a support fixture, an enclosure structure for suspending from the hanging wall structure, the enclosure structure being shaped to form an enclosure, and shaping means associated with the enclosure structure for maintaining an opening within the enclosure structure, such as by extending the enclosure structure outwardly from a vertically oriented surface, such as a door or a wall.

In another embodiment, a portable puppet theater, stage or playhouse includes a hanging wall structure for hanging the puppet theater or playhouse from a support fixture, an enclosure structure for suspending from the hanging wall structure, the enclosure structure being shaped to form an enclosure, and a shaped structure within the enclosure structure disposed to be pivotable between a first position extending the enclosure structure outwardly from the handing wall structure and a second position maintaining the enclosure structure substantially flush against the hanging wall structure.

In another embodiment, a method of using a portable puppet theater, stage or playhouse includes hanging the portable puppet theater, stage or playhouse so that an enclosure member in the puppet theater or playhouse is disposed in a first position extending outwardly from a hanging wall structure at a rear of the portable puppet theater, stage, or playhouse to provide an enclosure between the hanging wall structure and the enclosure member, and pivoting the enclosure member towards the hanging wall structure so that the enclosure member is flush with the door in a second position.

It should be understood that whenever an embodiment of the invention is referred to a portable puppet theater, stage or a playhouse, it can be used for any of these three purposes, as well as for a variety of other purposes. Thus, in any of the embodiments or descriptions given below, any mention of a portable puppet theater, stage or playhouse should be understood to refer to a portable puppet theater, stage and playhouse, and should not be limited to just one of a portable puppet theater, stage, or a playhouse.

Other aspects of the present invention, as well as features and advantages of various aspects of the present invention, will become apparent to those of ordinary skill in the art through consideration of the ensuing description, the accompanying drawings, and the appended claims.

DETAILED DESCRIPTION

In various embodiments, a portable playhouse, stage, or puppet theater of the present invention comprises an elongated unitary fabric member, also referred to herein as a "hanging wall structure," with a hanger element for hanging the portable playhouse, stage, or puppet theater from a support fixture of a building, such as the top of a door or a rod (e.g., a hanger rod, a curtain rod, etc.). The unit comprises a fabric member that is configured to hang downwardly from the support fixture (e.g., over the back of a door, etc.), extending toward or to the floor. The fabric member includes a fabric enclosure piece with a window therethrough. A generally U-shaped (e.g., semicircular, etc.), somewhat rigid shaping member may be positioned within the enclosure piece and adjusted to extend a portion of the enclosure fabric piece horizontally outward, away from the hanging wall structure, thereby forming an enclosure having a window facing away from the hanging wall structure. The enclosure may be large enough to house one or more children, and the window may be positioned so that the children can be hidden in the enclosure below the window or behind a hanging panel, while extending puppets into the window to act out a scene or story.

The fabric member may include ornamental pieces to simulate various themes, such as a castle, for a puppet show. The hanger member may be a simple dowel or pipe disposed within a loop at the upper end of the fabric, so that the dowel may hang over the top of the door. The theater may be easily assembled and dissembled. When dissembled, the theater unit is structured to lie flat and be folded over on itself, to form a small compact unit for storage or transportation in a small case or bag.

The present invention provides a portable unit that may readily serve as a portable playhouse, stage or a puppet theater. It requires very little assembly and can be easily stored. The unit is designed to be hung on the back of a door, so that no usable room space is needed. It provides for a small, confined and enclosed area that children enjoy using for playing, acting or for conducting a puppet show.

Figure 1:
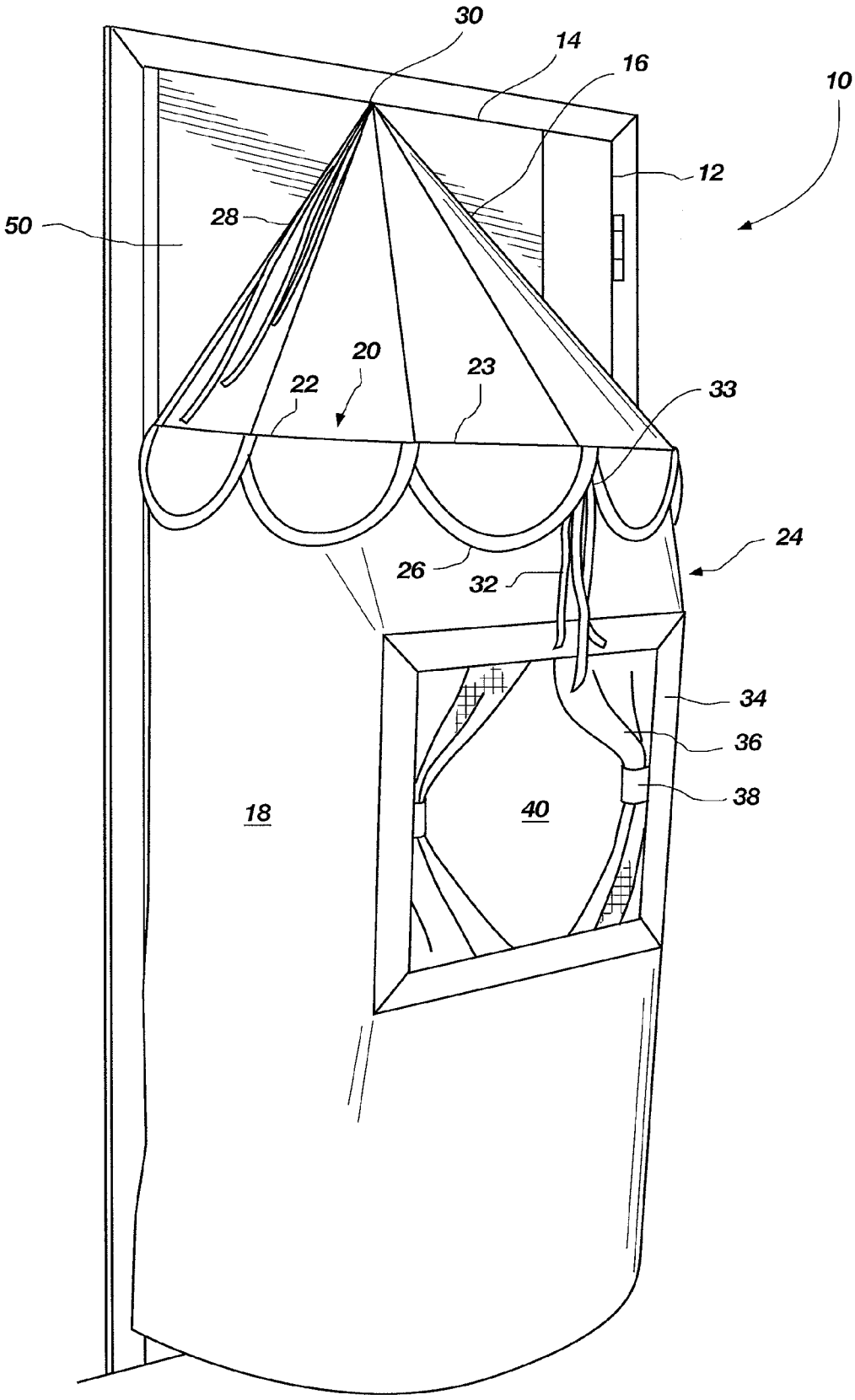
FIG. 1 is a perspective view of a portable puppet theater, stage or playhouse having a fairy tale castle theme, according to one embodiment.

Referring to FIG. 1, one embodiment of the present invention comprises a portable puppet theater, stage and playhouse 10 with a fairy tale castle theme. The puppet theater 10 is quickly installed by being hung over the back of an ordinary door 12. The puppet theater unit 10 may hang substantially the entire height of the door 12 and extend across substantially the width of the door 12. A peak 30 of a slanted roof 16 is secured in place relative to the top 14 of the door 12, and hangs vertically therefrom. Walls 18 hang from a horizontal roof base 20 disposed between the roof 16 and the walls 18.

A shaping member 22 is disposed at or below the roof base 20 within tops 23 of the walls 18. Shaping member 22 is bowed outwardly to cause the walls 18 to extend away from the door 12, so that the walls 18 form an enclosure 24 large enough to receive one or more persons.

Ornamental scallops 26 may hang from the roof base 20. Ornamental ribbons 28 may hang from the peak 30 at the top of roof 16, and other ornamental ribbons 32 may hang from the center 33 of the roof base 20. Ornamental ribbons and other decorative items and fabrics may be hung or attached to the puppet theater to create different themes.

The enclosure 24 may include a window 34 with curtains 36 that can be drawn back or pulled back with a tie 38. The window 34 may also have a privacy drape 40 that shields the people inside while they present a puppet show or play in the puppet theater 10. The drape 40 may be attached using snaps or Velcro (not shown) for easy removal to change scenes according to the show's theme. Alternatively the drape 40 may be rolled up and secured with loops (not shown) to allow visibility through the window 34.

Figure 2:
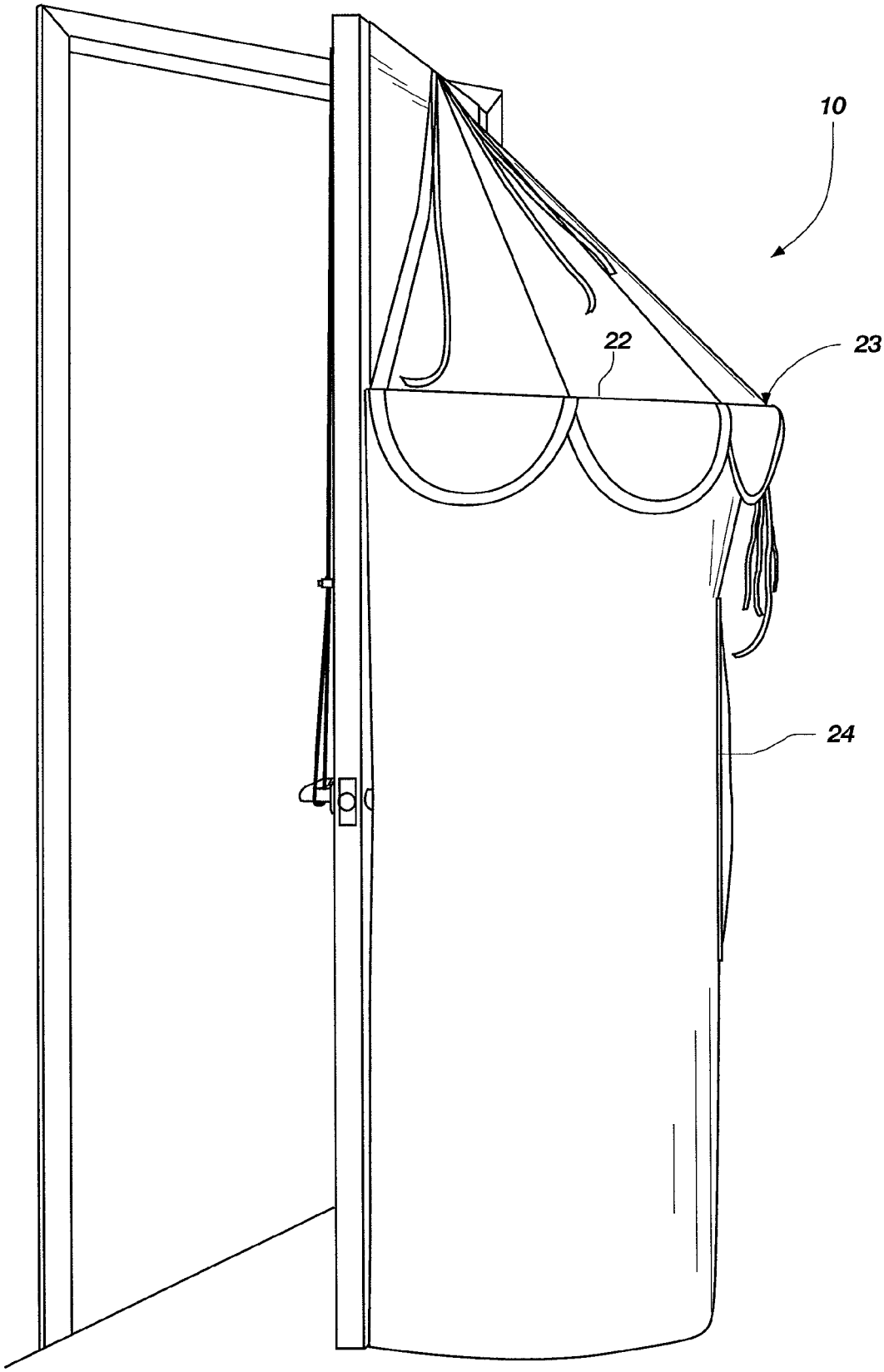
FIG. 2 is a side view of the puppet theater shown in FIG. 1.

FIG. 2 shows a side view of the puppet theater 10, in which the size of the enclosure 24 is seen more clearly. Shaping member 22 is embedded in the roof base 20 or at the tops 23 of walls 18 and causes the walls 18 to bow outward to form the enclosure 24. The enclosure 24 may be large enough for two or three children or one adult to easily fit inside and to stand upright. In addition, a chair (not shown) may be placed inside to seat a person.

Figure 3:
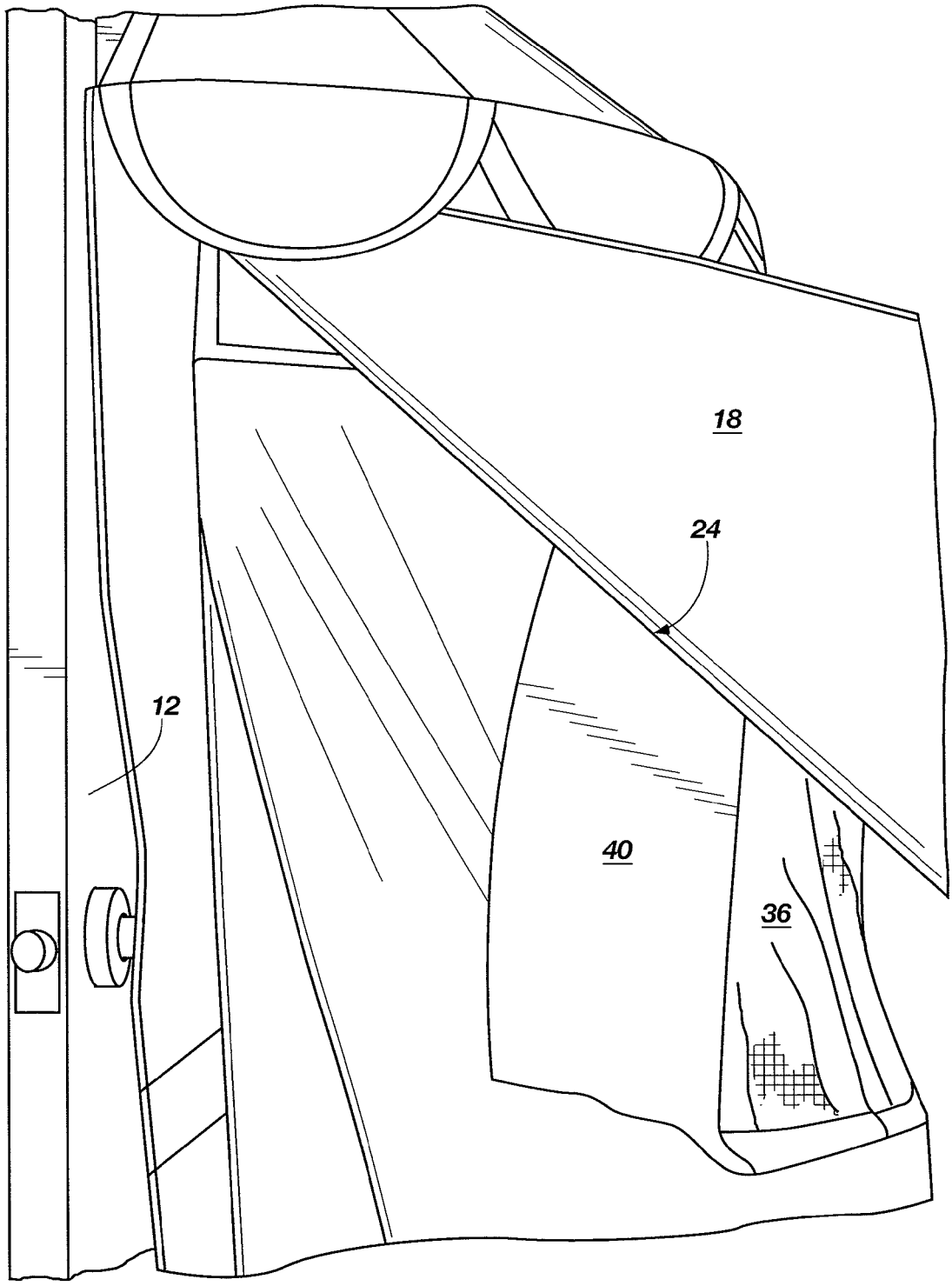
FIG. 3 is a perspective view of the enclosure within the puppet theater of FIG. 1.

As seen in FIG. 3, entry to the puppet theater 10 is enabled by pulling back a flexible portion 18F of the wall 18 next to the door 12 and stepping inside the enclosure 24. Curtains 36 and drape 40 may be located inside of window 34 (FIG. 1).

Figure 4:
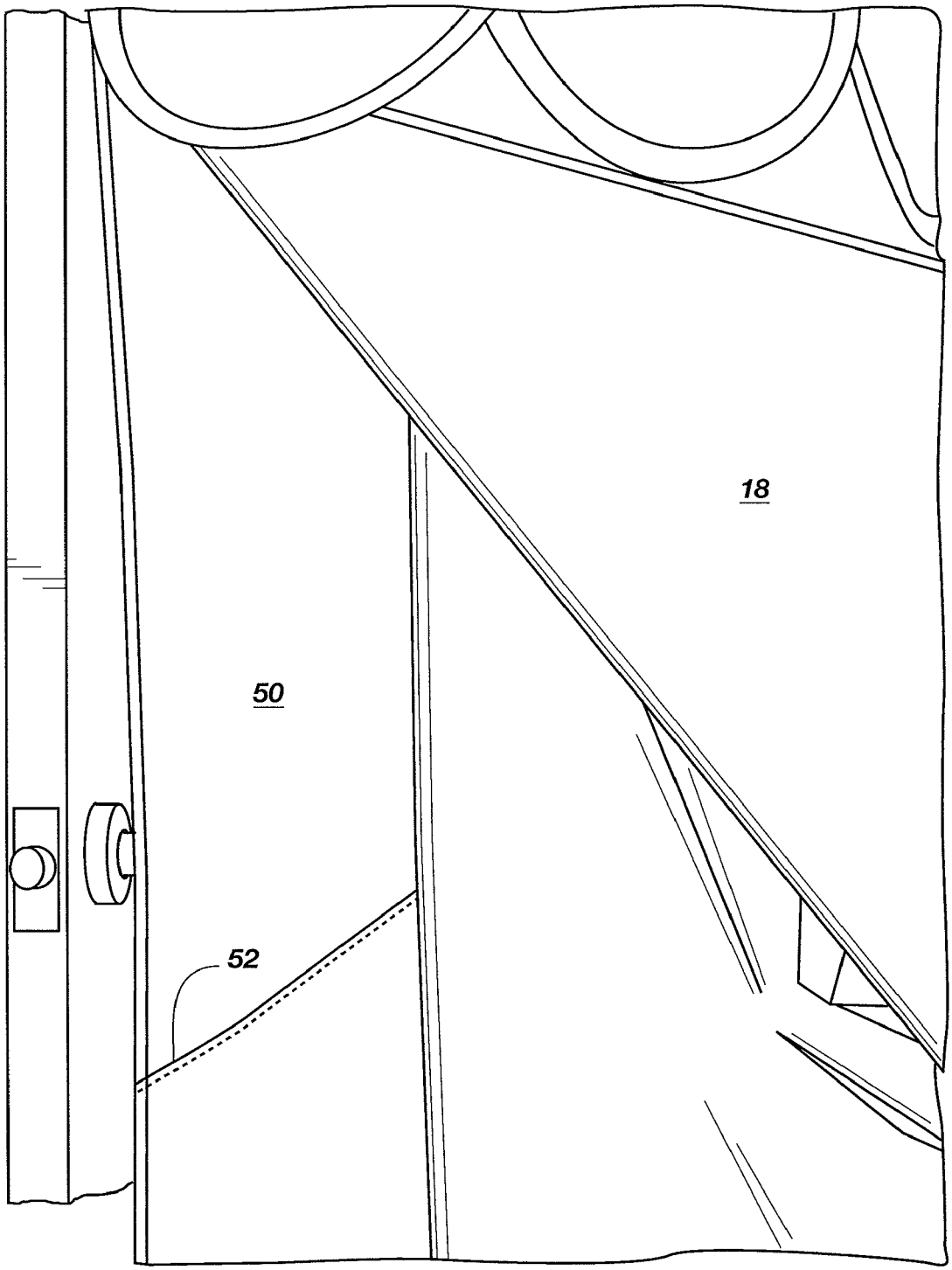
FIG. 4 is another perspective view of the enclosure within the puppet theater of FIG. 1.

In FIG. 4, the inside of the enclosure 24 is also shown. A hanging wall 50 forms the back side of the enclosure 24, extending from the top of the door 12 to the bottom of enclosure 24. Pockets 52 may be attached to the hanging wall 50 that are large enough to hold puppets, toys or other items (not shown). As seen in FIG. 1, hanging wall 50 may extend over the top 14 of door 12 to enable the puppet theater 10 to be secured to the door 12.

Figure 5:
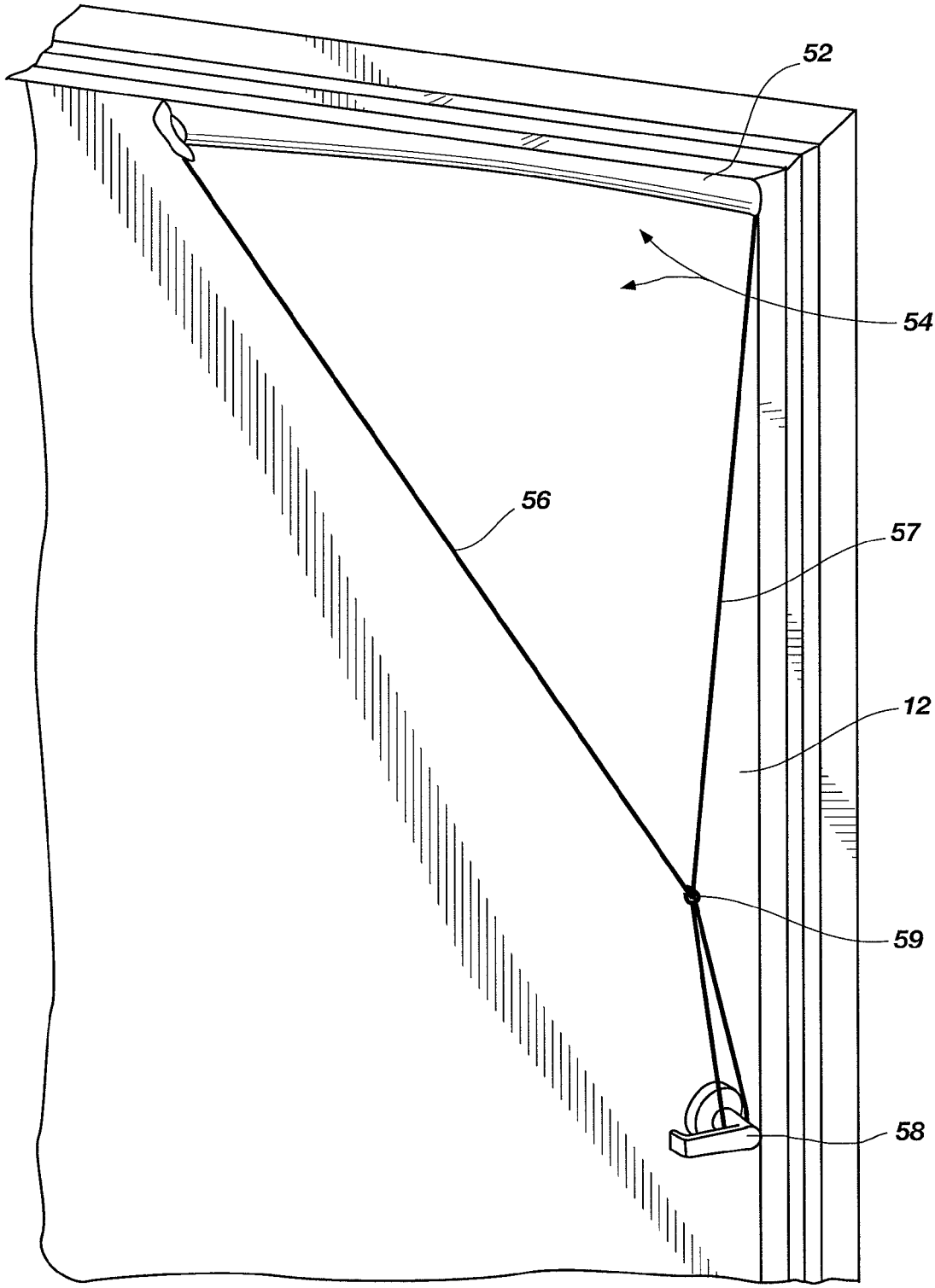
FIG. 5 is a perspective view of members that are used to hold the puppet theater in place, that is shown in FIG. 1.

Referring now to FIG. 5, the puppet theater unit 10 may be secured to the door 12 by a securing member 54 (e.g., a dowel, pipe, or other rigid, elongate element), secured within a top casing 52 of hanging wall 50 and draped over the top 14 of door 12. When the door 12 is shut, the securing member 54 is prevented by the shut door 12 from slipping over the top 14 of the door 12. The securing member 54 hanging over the top 14 of the door 12 may provide sufficient tension to hold up the puppet theater 10 without the door 12 being closed. However, when children play in the unit 10, then the door is usually closed to ensure that the puppet theater 10 does not fall.

To further secure the puppet theater 10, one or more ropes, cords, or straps 56 and 57 may also extend from the top 52 of the puppet theater 10 to a doorknob 58 of the door 12. Although two cords 56 and 57 are shown extending from the ends of the top 52 of the puppet theater 10 in the illustrated embodiment, a single rope, cord, or strap may be secured somewhat centrally to the top 52 of the puppet theater 10 and be secured to the door, minimizing any potential strangulation hazard. Each rope, cord, or strap 56, 57 secures puppet theater 10 from slipping when the door 12 is open. An adjustment slide 59 may be secured to each rope, cord, or strap 56 and 57 to keep them taut. Another casing and securing member (not shown) may be disposed at the bottom and/or intermediate of the hanging wall 50 to weigh down and, thus, provide tension on the hanging wall 50 to keep the unit 10 in place.

Figure 6:
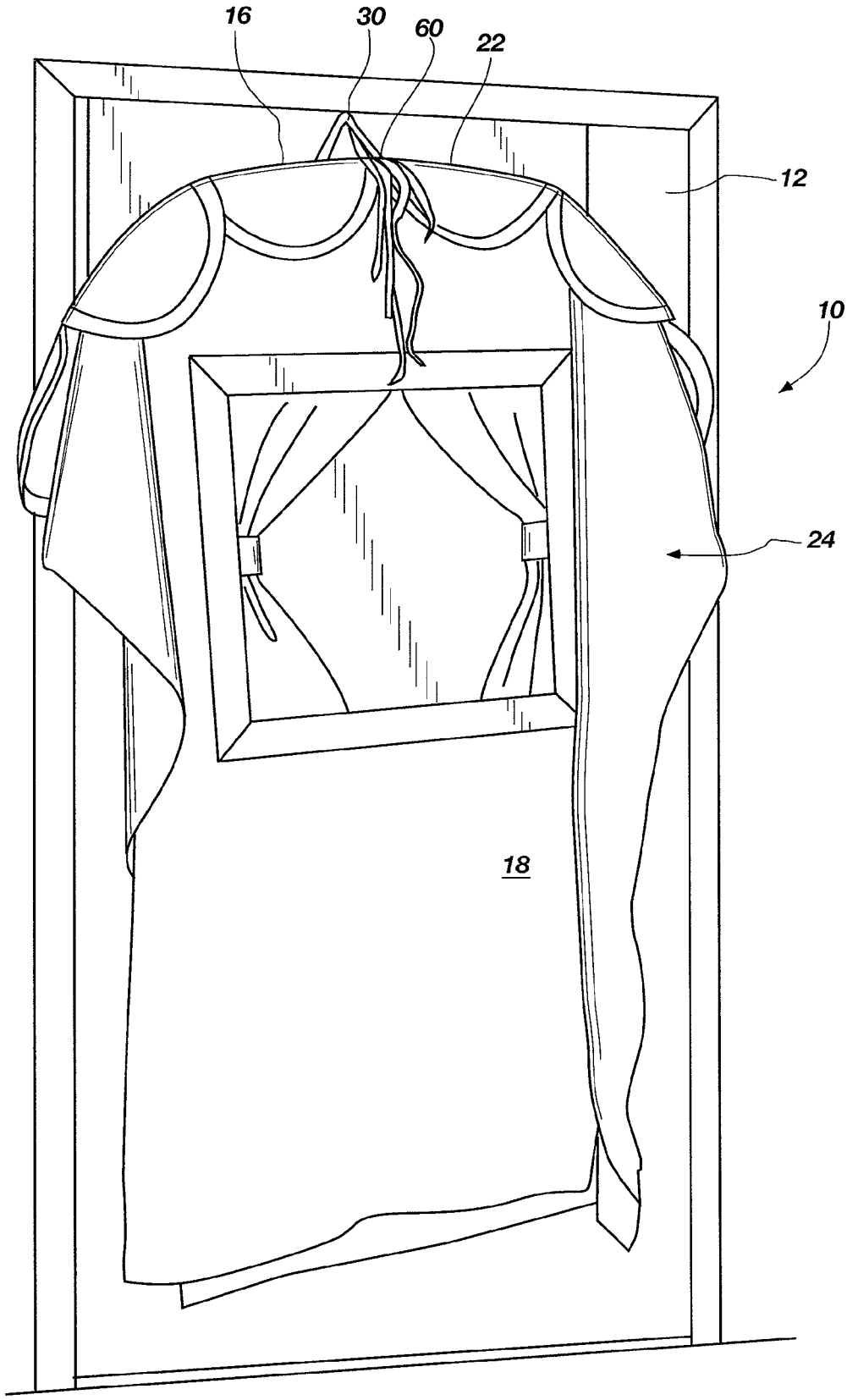
FIG. 6 is a perspective view of the puppet theater shown in FIG. 1, collapsed for storage on the back of a door.

Looking now at FIG. 6, the puppet theater 10 may be easily folded flat against the back of the door 12, by rotating the shaping member 22 upward towards the peak 30 of roof 16. In this position the shaping member 22 is essentially flush against the surface of the door 12 and enclosure 24 has been collapsed. Moreover, the roof 16 (not visible) and the walls 18 are also substantially flush against the surface of the door 12. One of ribbons 28 (shown in FIG. 1) hanging from the peak 30 of the roof 16 may be tied with one of ribbons 32 (shown in FIG. 1) attached to the roof base 20, forming a bow 60 near the peak 30. Alternately, snaps, VELCRO® and other attachment members may be used for the same purpose. Further, another alternative is to have one portion of the puppet theater folded and attached to another piece by snaps, Velcro, ribbons or in any other fashion to reduce the size of the enclosure 24.

Figure 7:
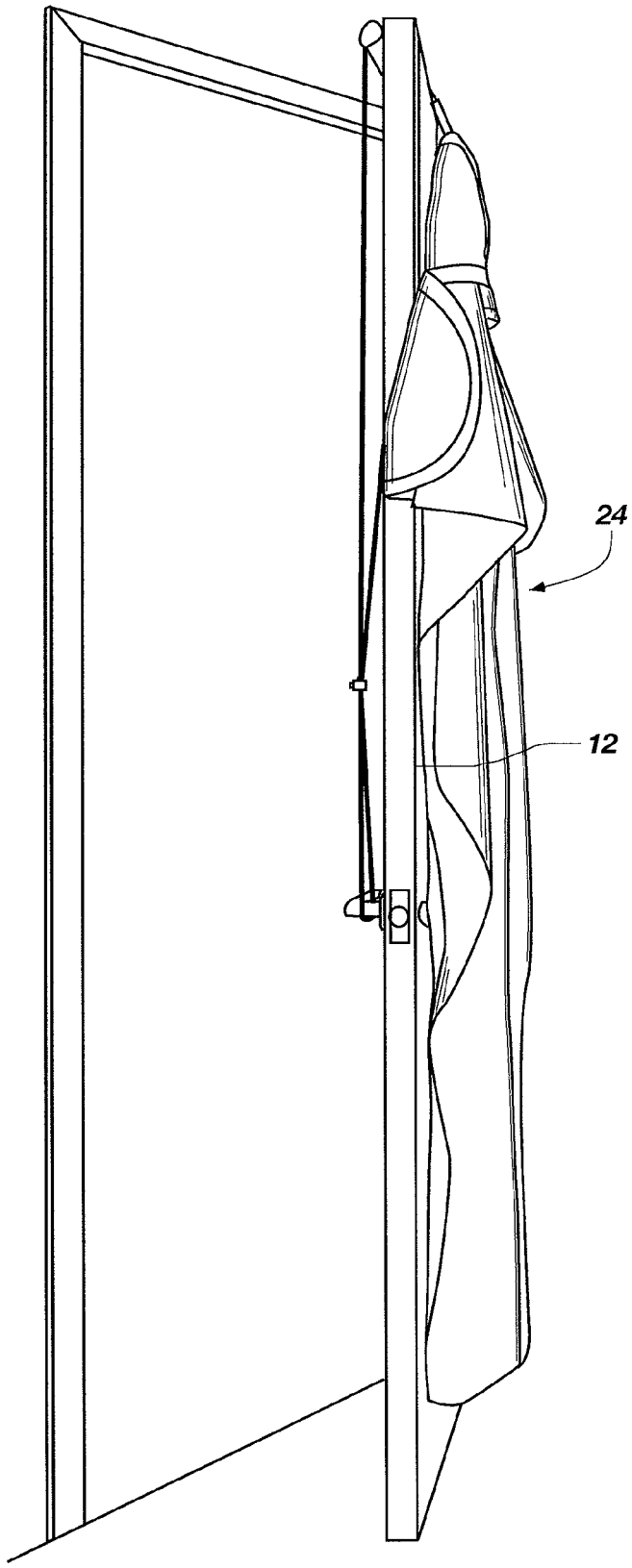
FIG. 7 is a side view of the puppet theater shown in FIG. 5, collapsed for storage on the back of a door.

FIG. 7 shows a side view of the puppet theater 10 with the enclosure 24 collapsed against the back of door 12, pulling the puppet theater flatly against the back of the door 12. In this position, the roof 16 is collapsed behind the walls 18 and window 34. Fastener strips (not shown) may be placed in the edges of the walls 18 to keep the walls 18 tucked in behind the door 12.

Figure 8:
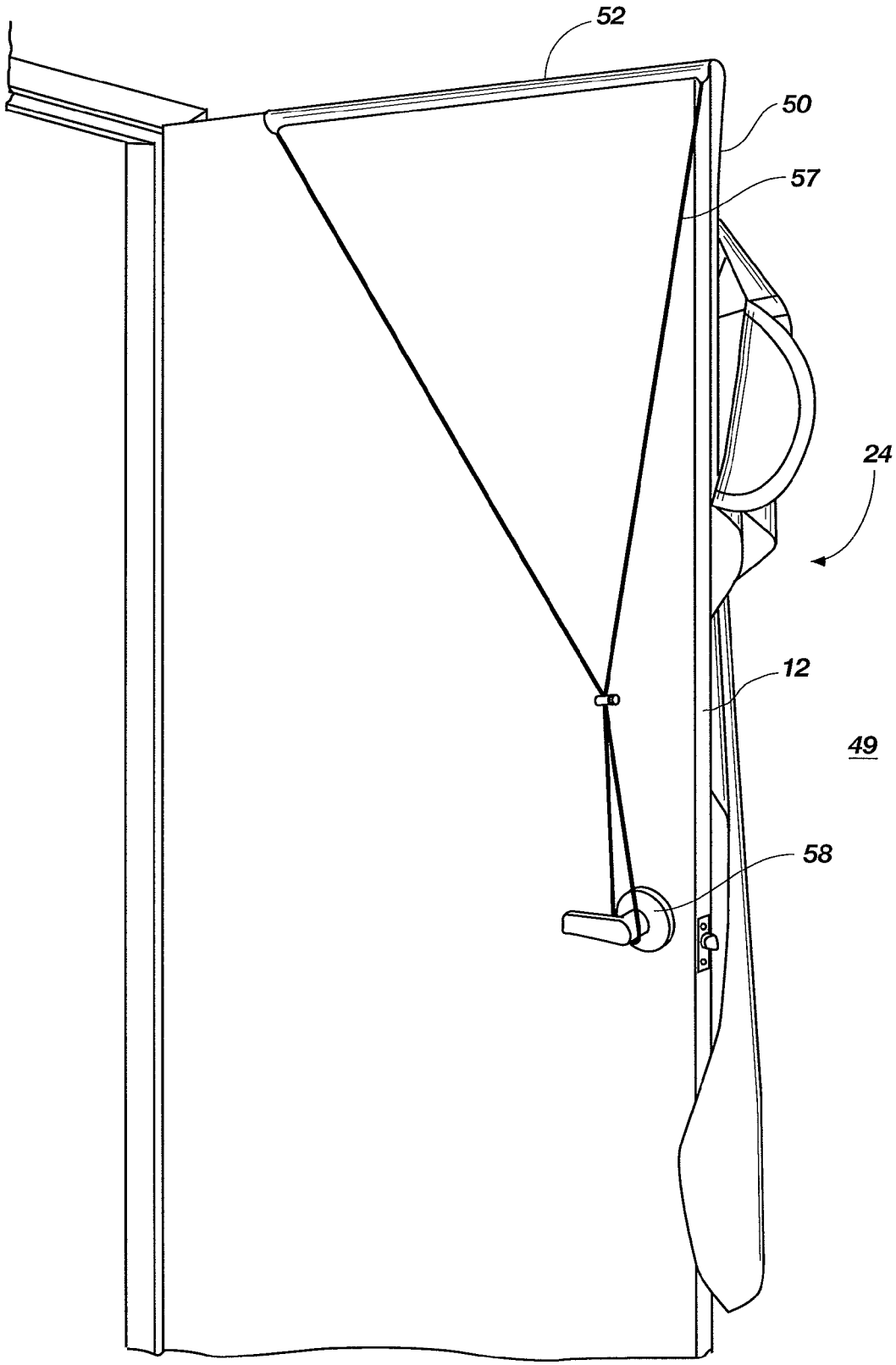
FIG. 8 is a perspective of the door on which the puppet theater shown in FIG. 5 is collapsed, with the door in a fully-opened position.

FIG. 8 demonstrates that the collapsed enclosure 24 in FIGS. 6 and 7 enables the puppet theater 10 to be stored on the back of the door 12, so that the door 12 can be opened against a wall 49 of a house or other building.

Figure 9:
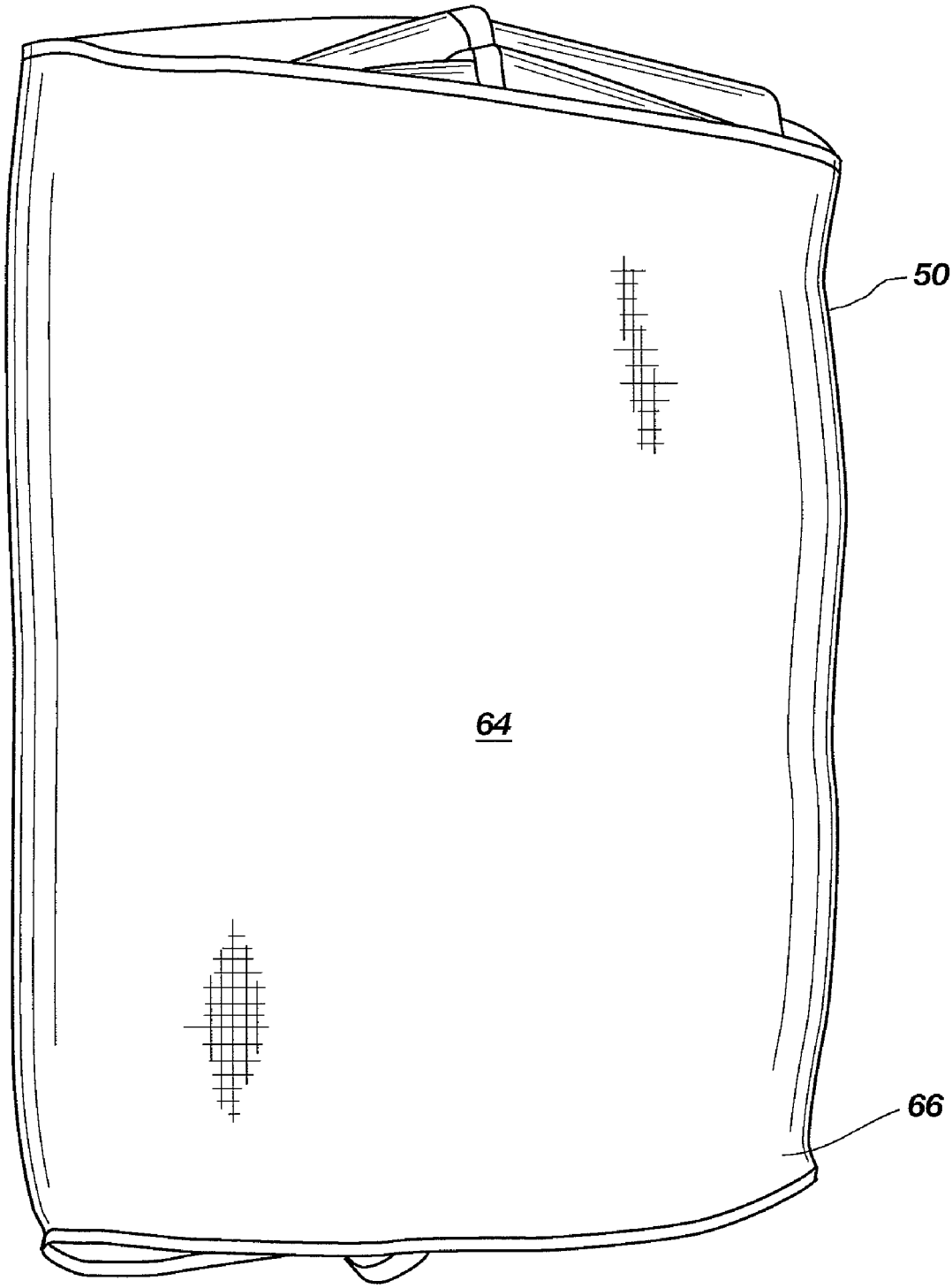
FIG. 9 is a view of the puppet theater shown in FIG. 1, folded for permanent storage.

Looking now at FIG. 9, for long term storage, the puppet theater 10 may be laid flat on a horizontal surface in the same collapsed disposition shown in FIG. 6. The theater unit 10 may then be folded in on itself and the hanging wall 50 folded over the unit 10, resulting in a flat unit 64, convenient for storage under a bed, in a closet or other small area. The hanging wall 50 may be secured in the folded position shown in FIG. 9 using pins 66, snaps, VELCRO® or the like.

In the embodiment shown in FIGS. 1-9, the unit 10 may be a tent-type theater/playhouse that is 29 inches wide by 83 inches tall by 21 inches deep made of non-rip nylon fabric of various colors. Other such fabrics may be chosen that are light-weight and durable to withstand the wear and tear of use by children. The unit 10 may be hung from a door, vertical wall or other surface, as needed.

The window 34 may be placed at a child's eye level with the opening 28 inches to 42 inches off the floor. A reinforcement member (e.g., a blanket binding, etc.) may be disposed about the window frame 35 to prevent ripping of the window opening. One or more edges of the window 34 may be internally reinforced (e.g., with a plastic strip, etc.) to prevent sagging and to maintain a desired shape of the window 34 opening. The window may be any size and shape. In the illustrated embodiment, the window 34 is rectangular, with dimensions of 17 inches by 14 inches.

The curtains 36 may be 22 inches by 24 inches for each panel, and may be gathered by the fastener strip 38 of about 21 inches. Alternately, the curtains may be secured by three hook and loop pieces, one in the middle and one on each end. These loops may provide for easy disassembly for storing the curtains.

The drape 40 may be a 25 inches by 25 inches piece of non-rip fabric having finished edges and a 21 inch piece of fastener material attached to the top. This drape 40 may be hung on the inside of the unit 10 so that it can be hung to cover the window opening 34 allowing the curtains 36 to still be seen from the outside. Alternatively, the drape 40 may be rolled up and secured with the fastener loops. The drape 40 may include a scene to serve as backdrop for a puppet show or it may be plain. The drape 40 may serve to shield a puppeteer from the audience (e.g., by being disposed between the puppeteer's body and the window 34) during a performance.

The walls 18 of the unit 10 may be 59 inches wide by 57 to 84 inches high with the bottom of the window 34 about 28 inches from the floor or bottom edge of the wall 18. A strip of fabric may be sewn on the top edge of the wall 18 as a casing to hold a shaping member (not shown) that provides form to the puppet theater.

The shaping member 22 may be formed by a plastic strip that is bowed into a circular shape and sewn into the wall fabric. Alternately, the strip may be formed in any shape desired. The plastic strip may be 2½ inches by 58 inches with rounded edges for easy insertion through the casing. The plastic strip may be made from vinyl or other flexible spring-like material that may flatten out when not being used and may readily spring back into shape during usage. Alternately, shaping member 22 may formed of spring steel, aluminum, fiberglass, or other suitable material. As an example, the shaping member may be ½ inch feeler gauge spring metal. Alternately, the shaping member may be fabricated into any desired shape, rather than being flexed, which can then be sewn into the walls 18 or the roof base 20. In the illustrated embodiment, the unit 20 extends away from the back of the door 12 about 21 inches to form enclosure 24. However, the shaping member may extend any length from the door and may be formed in any shape.

For ornamentation, the scallops 26 shown in FIG. 1 may be sewn to the tops of the walls 18 along roof base 20. These decorations may be finished with a double folded quilt binding. The roof 16 may be made of either one solid color or multiple panels of alternating colors for an awning look. The sides of the roof 16 may be covered with a quilt binding that finishes the edge and gives strength when attached to the hanging wall 50.

The hanging wall 50 of the unit may be 29 inches wide by 57 to 84 inches long. Alternately, the hanging walls 50 may be larger or smaller to accommodate different sized doors. A typical door height might be 80 to 84 inches, but the hanging wall could accommodate any size door. The casing 52 at the top of the hanging wall may be about 2 inches and may be made by folding a fabric piece over two inches on the top and on the bottom.

The securing member 54 inside the casing 52 may be a dowel or pipe or other suitable member. In the present embodiment, securing member 54 comprises one or two 27½ inch pieces made of ½ inch conduit such as PVC pipe. Alternately, the securing member 54 may be a catch (not shown), such as a U-shaped member, that is shaped to fit on the top of the door and secure the puppet theater to the door 12. Securing member may be adjustable in length to accommodate any width of door.

A second securing member (not shown) may be disposed at the bottom of the hanging wall 50 or anywhere on the hanging wall 50, such as along the line where the top of the walls 18 meets the roof base 20. This second member may also be made of a wooden dowel, metal or fiberglass piece or plastic member such as conduit. The hanging wall 50 may comprise another piece of fabric having dimensions of 29 inches wide by 84 inches high. The hanging wall 50 may include a fold at the bottom about 8 inches long and sewn several times to form one or more pockets 52.

Figure 10:
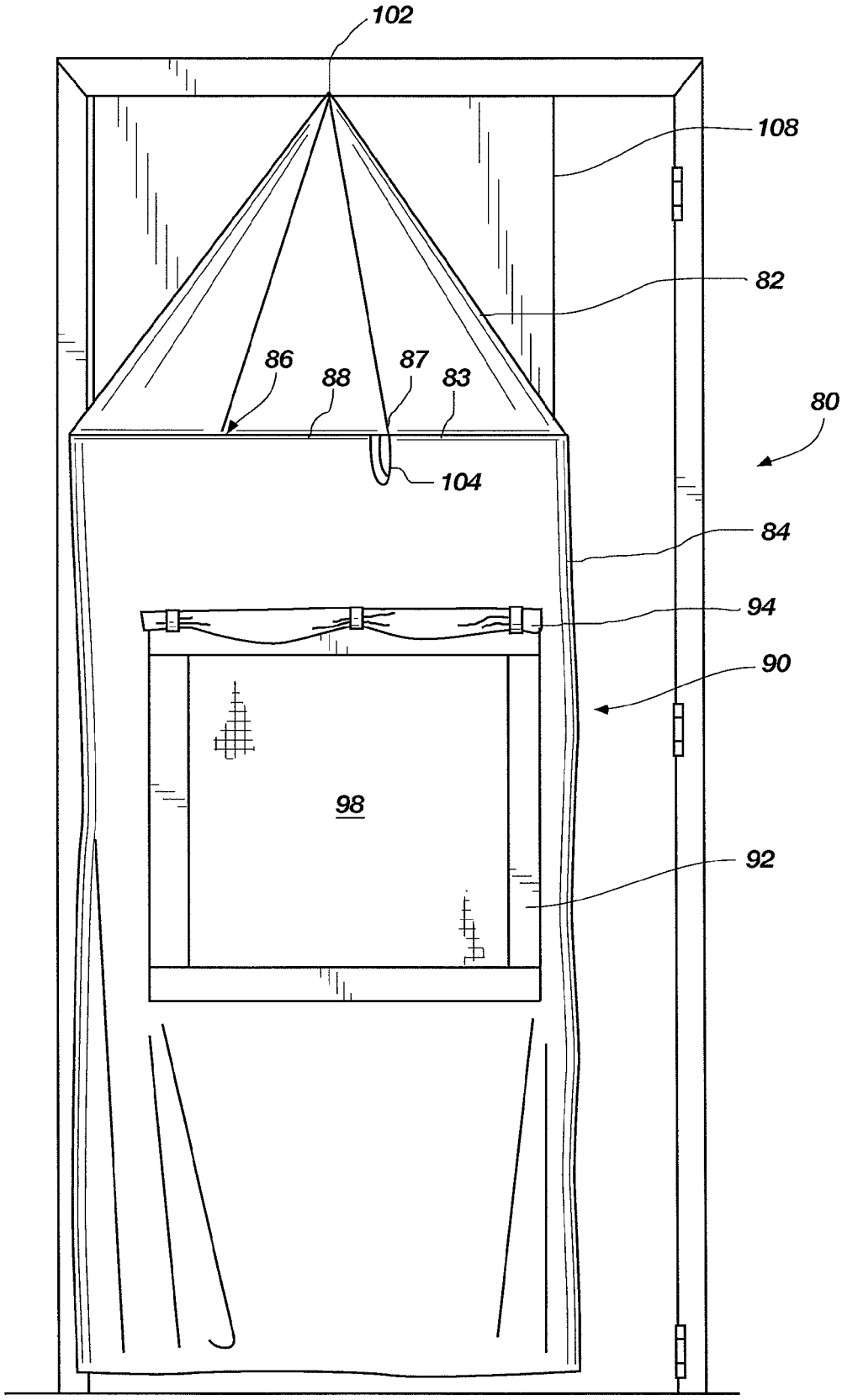
FIG. 10 is another embodiment of a portable puppet theater, stage or playhouse using a military theme.

Looking now at FIG. 10, another type of playhouse or puppet theater 80 is shown having a military theme. In this embodiment, green khaki colors may be used with a camouflage presentation on walls 84. However, the structural arrangement is the same as the prior embodiment. As before, a roof 82 extends vertically to walls 84 that drop downward to or near the floor. Just below the roof base 86, a flexible member 88 is inserted in the tops 83 of walls 84 to force the walls 84 away from the door 12, forming an enclosure 90. A window 92 is disposed at the front of enclosure 90 with a curtain 94 and a drape 98, which may also include a mesh see-through cover 98.

A ribbon 100 is located at the peak 102 of the roof 82, and another ribbon 104 is disposed at the center 87 of the roof base 86. The unit 80 may be flattened against the back of door 12 by rotating the shaping member 88 upwards against the hanging wall 50 and tying ribbons 100 and 104 together. Alternately, the one portion of the puppet theater may be folded and attached to another piece by snaps, Velcro, ribbons or in any other fashion to reduce the size of the enclosure 90. Likewise, a hanging wall 108 enables the unit to be hung on the door 12 and to be folded into a flat unit to be stored away.

Figure 11:
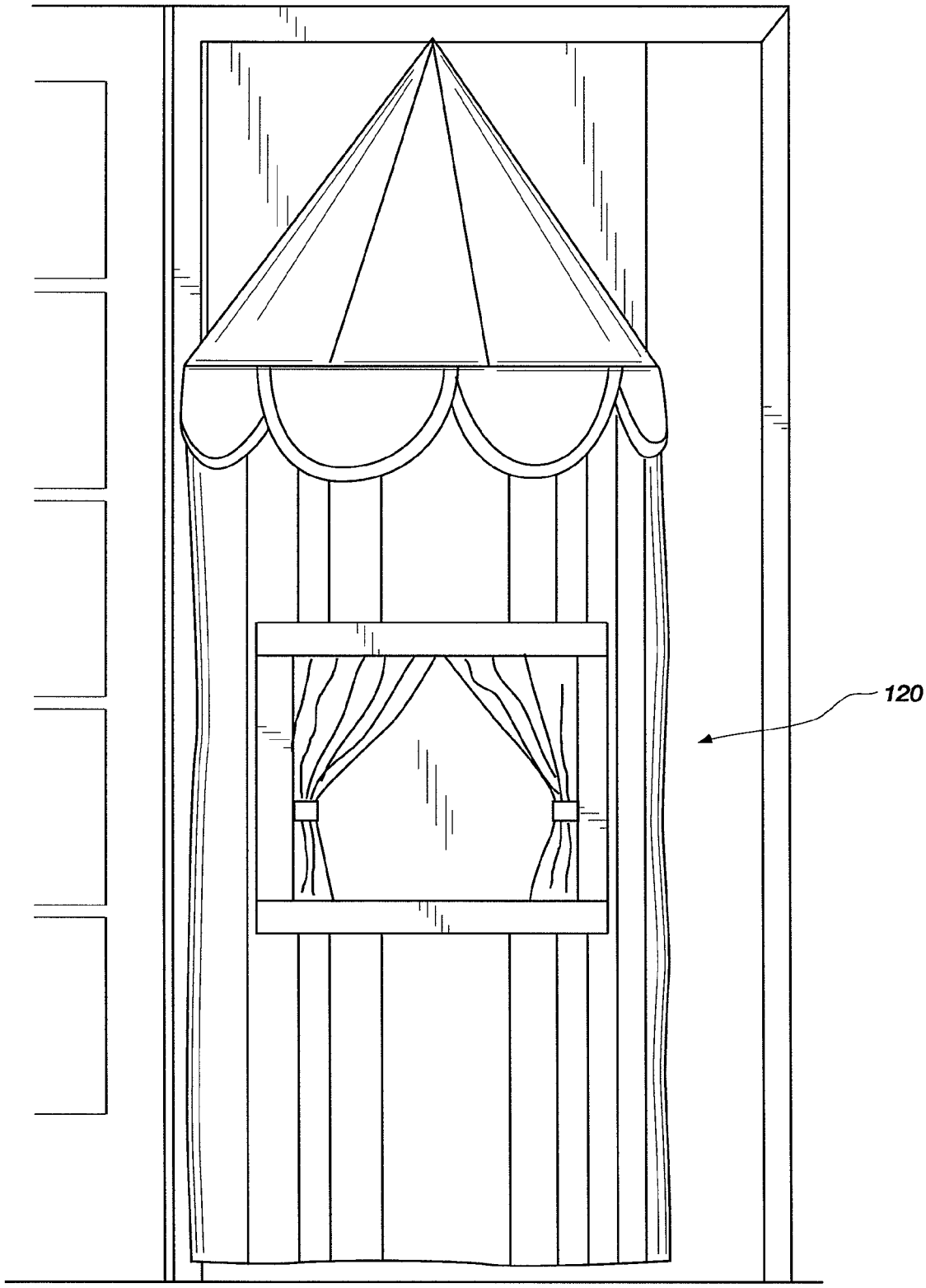
FIG. 11 is another embodiment of a portable puppet theater, stage or playhouse using a medieval tent or tower theme.

FIG. 11 shows another embodiment of puppet theater 120 with a medieval tent or tower theme. The ornamental features of this embodiment are focused on appearing as a tent or tower from long ago. However, the structural aspects of puppet theater 120 are the same as those of puppet theater 10. It can be understood that a limitless variety of other themes could be employed in a similar manner.

Although the above-described embodiments are representative of the present invention, other embodiments will be apparent to those skilled in the art from a consideration of this specification and the appended claims, or from a practice of the embodiments of the disclosed invention. It is intended that the specification and embodiments therein be considered as exemplary only, with the present invention being defined by the claims and their equivalents.

What is claimed is:

1. A portable puppet theater, stage or playhouse comprising:

hanging wall structure for hanging the puppet theater, stage or playhouse from a door or other vertical surface, enclosure structure for suspending from the hanging wall structure, the enclosure structure being shaped to form an enclosure, and a bowed member within the enclosure structure for extending the enclosure structure away from the door or other vertical surface.

2. The portable puppet theater, stage or playhouse of claim 1, wherein the hanging wall structure includes an upper portion formed to drape up to or over the top of the door or other vertical surface to hold the portable puppet theater, stage or playhouse in place on the door or other vertical surface.

3. The portable puppet theater, stage or playhouse of claim 2, wherein the upper portion of the hanging wall structure includes a catch for holding the portable puppet theater, stage or playhouse in place on the door or other vertical surface.

4. The portable puppet theater, stage or playhouse of claim 1, wherein the enclosure structure includes a roof member and a wall member connected to the roof member.

5. The portable puppet theater, stage or playhouse of claim 4, wherein the wall member includes a window between the enclosure and outside of the wall member.

6. The portable puppet theater, stage or playhouse of claim 1, wherein the shaping means is pivotable, so that the shaping means and the enclosure structure are positioned substantially flush with the door.

7. A portable puppet theater, stage or playhouse comprising:

hanging wall structure including a top portion with a casing and a catch member on the top portion for hanging the portable puppet theater, stage or playhouse from a door or other vertical surface, roof structure attached to the hanging wall structure, enclosure structure attached to the roof structure, the enclosure structure being shaped to form an enclosure, and shaped structure within the enclosure structure disposed to be pivotable between a first position extending the enclosure structure away from the door, and a second position maintaining the enclosure structure substantially flush against the door.

8. The portable puppet theater, stage or playhouse of claim 7, wherein the casing has a semicylindrical member therein to hold the hanging structure when the door is closed.

9. The portable puppet theater, stage or playhouse of claim 7, and further comprising a cord member extending from the top portion of the hanging structure to a doorknob on the door, to further secure the hanging wall structure.

10. The portable puppet theater, stage or playhouse of claim 7, wherein the roof structure comprises a slanted roof member extending from a top of the hanging wall structure to the enclosure structure.

11. The portable puppet theater, stage or playhouse of claim 10, wherein the slanted roof member extends to the shaping member within the enclosure member.

12. The portable puppet theater, stage or playhouse of claim 7, further comprising securing means for maintaining the shaping member in the second position.

13. The portable puppet theater, stage or playhouse of claim 7, wherein the enclosure structure includes a window.

14. The portable puppet theater, stage or playhouse of claim 7, wherein the hanging wall structure and the enclosure structure are fabricated of flexible material.

15. The portable puppet theater, stage or playhouse of claim 14, wherein the hanging wall structure is disposed so as to be removed from the door and to be folded over the enclosure structure with the shaped structure in the second position so that the puppet theater or playhouse may be easily stored.

16. A method of using a portable puppet theater, stage or playhouse, comprising hanging the portable puppet theater, stage or playhouse on a surface of a door or other vertical surface, including draping an upper portion of a hanging wall structure of the portable puppet theater, stage or playhouse up to or over the top of the door or other vertical surface to hold the portable puppet theater stage or playhouse in place on the door or other vertical surface so that an enclosure member in the portable puppet theater, stage or playhouse is disposed in a first position extending outward from the surface of the door to provide an enclosure between the surface of the door and the enclosure member, and pivoting the enclosure member towards the surface of the door so that the enclosure member is flush with the surface of the door in a second position.

17. The method of claim 16, further comprising securing the enclosure member in the second position to store the portable puppet theater, stage or playhouse in a compact position on the surface of the door.

18. The method of claim 16, further comprising removing the portable puppet theater, stage or playhouse from the surface of the door with the enclosure member in the second position and folding the portable puppet theater, stage or playhouse on itself to form a compact member for storage.

* * * * *